US005596781A

United States Patent [19]

Graebe

[11] Patent Number: 5,596,781

[45] Date of Patent: Jan. 28, 1997

[54] VACUUM/HEAT FORMED CUSHION WITH PYRAMIDAL, INFLATABLE CELLS

[75] Inventor: Robert H. Graebe, St. Clair County, Ill.

[73] Assignee: Crown Therapeutics, Inc., Belleville, Ill.

[21] Appl. No.: 546,451

[22] Filed: Oct. 20, 1995

Related U.S. Application Data

[60] Division of Ser. No. 328,724, Oct. 25, 1994, Pat. No. 5,561,875, which is a continuation-in-part of Ser. No. 12,580, Feb. 3, 1993, Pat. No. 5,369,828, which is a division of Ser. No. 839,305, Feb. 2, 1992, abandoned.

[51] Int. Cl.[6] ..... A47C 27/10

[52] U.S. Cl. ..... 5/710; 5/654; 5/655.3

[58] Field of Search ..... 5/654, 653, 455, 5/449, 465, 464, 710, 655.3; 297/452.41, 284.6, DIG. 3; 428/72, 178; 156/210, 292, 290, 308.4, 285, 195, 209, 286

[56] References Cited

U.S. PATENT DOCUMENTS

| | | | |
|---|---|---|---|
| D. 294,212 | 2/1988 | Sias et al. . | |
| D. 335,235 | 5/1993 | Hildreth . | |
| 611,585 | 9/1998 | Andres | 5/458 |
| 1,576,211 | 3/1926 | O'Kane | 5/455 |
| 1,777,477 | 10/1930 | Sampson . | |
| 2,069,422 | 2/1937 | Sampson . | |
| 2,239,300 | 4/1941 | O'Dell et al. . | |
| 2,434,641 | 1/1948 | Burns | 5/654 |
| 2,491,557 | 12/1949 | Goolsbee | 5/455 |
| 2,575,764 | 11/1951 | Morner | 428/72 |
| 2,672,183 | 3/1954 | Forsyth | 5/455 |
| 2,800,165 | 7/1957 | Talalay et al. . | |
| 2,823,394 | 2/1958 | Smith | 5/455 |
| 3,605,145 | 9/1971 | Graebe . | |
| 3,681,797 | 8/1972 | Messner . | |
| 3,822,425 | 7/1974 | Scales . | |
| 3,870,450 | 3/1975 | Graebe . | |
| 4,005,236 | 1/1977 | Graebe . | |
| 4,068,334 | 1/1978 | Randall . | |
| 4,076,872 | 2/1978 | Lewicki et al. . | |
| 4,279,044 | 7/1981 | Douglas . | |
| 4,325,151 | 4/1982 | Wu | 5/644 |
| 4,422,194 | 12/1983 | Viesturs et al. | 5/455 |
| 4,424,599 | 1/1984 | Hannouche . | |
| 4,485,505 | 12/1984 | Paul . | |
| 4,541,136 | 9/1985 | Graebe . | |
| 4,605,582 | 8/1986 | Sias et al. . | |
| 4,614,000 | 9/1986 | Mayer . | |
| 4,673,605 | 6/1987 | Sias et al. . | |
| 4,698,864 | 10/1987 | Graebe | 297/DIG. 3 |
| 4,730,610 | 3/1988 | Graebe . | |
| 4,777,679 | 10/1988 | DeLooper . | |
| 4,796,948 | 1/1989 | Paul et al. . | |
| 4,809,374 | 3/1989 | Saviez | 5/420 |

(List continued on next page.)

FOREIGN PATENT DOCUMENTS 1545806 5/1979 United Kingdom .

OTHER PUBLICATIONS

TRI–MAX Information Sheet D–8083 dated Jan. 1, 1989.

*Primary Examiner*—Alexander Grosz
*Attorney, Agent, or Firm*—Howell & Haferkamp, L.C.

[57] ABSTRACT

A vacuum or heat formed cushion having upstanding cells of thin (15–40 mil) wall thickness and having rectangular body sections with upwardly inclined (10°–40°) triangular top panels. The cushions can be attached together to form a mattress or used individually as a wheelchair or other chair or back cushion. The cells of the cushion can all be interconnected or the cushion can be divided in two or more independently inflated compartments. A special wheelchair cushion has cells of different shapes, sizes and heights to promote positioning of a user on a wheelchair.

The cushion has openings through the base to allow it to be placed on a manifold so that body fluids can drain away from the patient and conditioned air can be supplied to the patient.

The top surfaces of the cells are textured to prevent sealing off the pores of the user's skin.

19 Claims, 11 Drawing Sheets

U.S. PATENT DOCUMENTS 4,860,397 8/1989 Gusakov .
4,864,671 9/1989 Evans .
4,866,800 9/1989 Bedford .
4,896,389 1/1990 Chamberland .
4,962,553 10/1990 Marquis ..... 5/465
4,982,466 1/1991 Higgins et al. .
5,002,336 3/1991 Feher .
5,030,501 7/1991 Colvin et al. .
5,052,068 10/1991 Graebe ..... 5/654
5,152,023 10/1992 Graebe ..... 5/654
5,153,956 11/1992 Nold .
5,163,196 11/1992 Graebe et al. ..... 5/654
5,163,737 11/1992 Navach et al. .
5,176,424 1/1993 Tobita et al. .
5,193,237 3/1993 Holdredge .
5,329,656 7/1994 Leggett .
5,369,828 12/1994 Graebe ..... 5/654
5,378,045 1/1995 Siekman et al. .
5,395,162 3/1995 Jay et al. .
5,444,881 8/1995 Landi et al. ..... 5/654

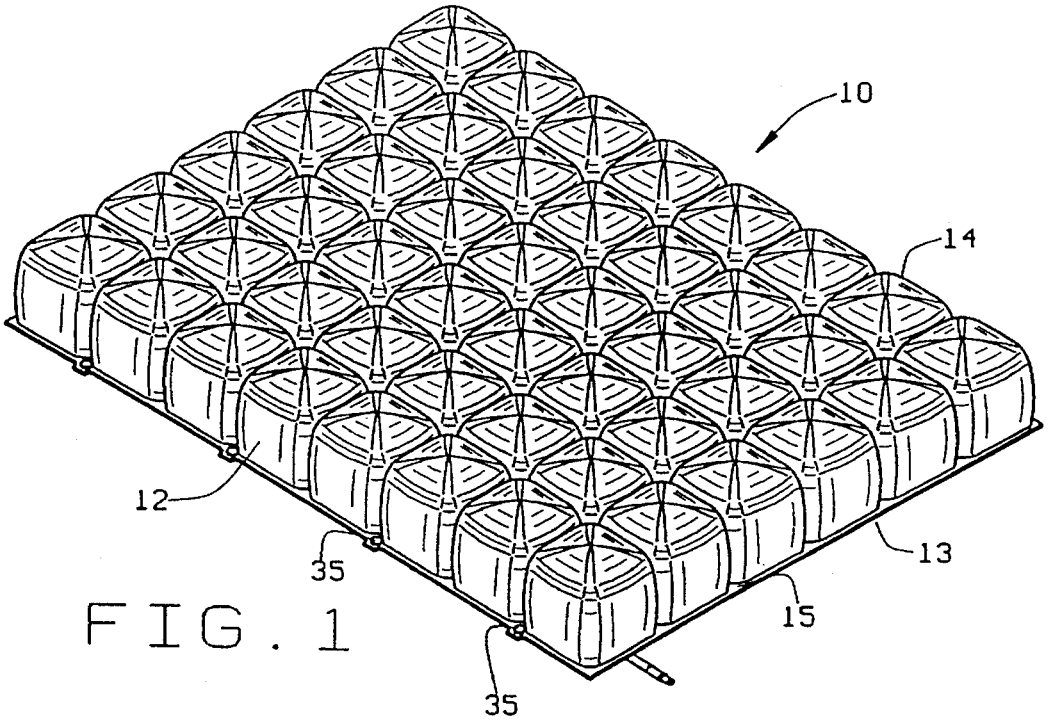
FIG. 1
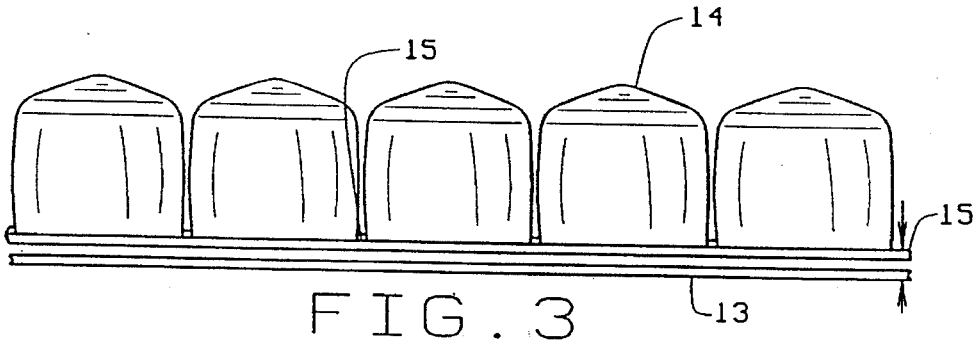
FIG. 3
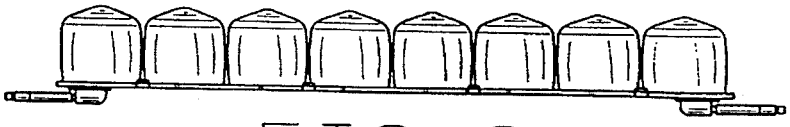
FIG. 6
FIG. 7
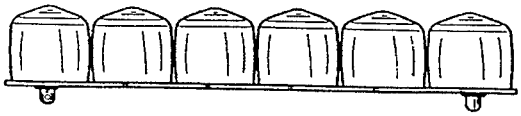

VACUUM/HEAT FORMED CUSHION WITH PYRAMIDAL, INFLATABLE CELLS

RELATED APPLICATIONS

This is a division of prior pending application Ser. No. 08/328,724, filed Oct. 25, 1994, entitled VACUUM/HEAT FORMED CUSHION, now U.S. Pat. No. 5,561,875, which application is a continuation-in-part of prior application Ser. No. 08/012,580, filed Feb. 3, 1993 now U.S. Pat. No. 5,369,828 entitled MODULAR CUSHION CONSTRUCTION WITH FOAMED BASE which is a division of application Ser. No. 07/839,305 filed Feb. 2, 1992 entitled MODULAR CUSHION CONSTRUCTION WITH FOAMED BASE (now abandoned)

BACKGROUND OF THE INVENTION

This invention relates in general to cushioning devices, particularly to cushions having a plurality of inflatable cells, and specifically to cushions having a series of cells formed from a thermoplastic polymer.

Conventional cushioning devices for supporting the human body, such as the typical mattress, seat cushion or padded back rest, do not distribute the weight of the supported body evenly over the area of the body that is in contact with the cushioning device. For example, in the case of a mattress, the buttocks or hips, and likewise the shoulders, sink further into the mattress than the lumbar region of the back. Since most conventional cushioning devices exert a supporting force that is proportional to the amount they are deflected, those portions of the body which sink deepest into the cushioning device experience a resisting force per unit area that is considerably greater than those body portions that deflect the cushioning device only slightly. For those individuals who are confined to beds or wheelchairs for extended periods of time the unequal distribution of supporting forces deforms the vascular system and reduces blood flow which can lead to extreme discomfort and can even be debilitating in the sense that bed sores often develop at the skin areas where the supporting force is greatest While cushions which derive their cushioning properties from inner springs or foam material are quite common and inexpensive to manufacture, they suffer the inability to distribute loads or develop restoring forces evenly to the object they are supporting.

I have patents which relate to cushions which have upstanding interconnected air cells which distribute the supporting forces more evenly and indeed generally uniformly over the entire supported area. These cushions employ a series of air cells which are extended generally perpendicular from a base and are, therefore, oriented generally perpendicular to the contacting surface of the body that they support. Moreover, all of the cells are interconnected and, therefore, exist at the same internal pressure irrespective of the extent of deflection. Since the ends of the cells actually contact the supported body, it is desirable to have the cells arranged quite closely for this enables the ends of the cells to resemble a generally continuous surface. Perhaps the most refined air cell cushions currently available are fabricated in rubber via a dipping process and are disclosed in U.S. Pat. Nos. 3,870,450, 4,005,236 and 4,541,136. To facilitate the dipping and assembly process, the air cells of these cushions have a fluted configuration, each with a number of fins, so that when the cells are inflated they will expand laterally into contact with each other and their ends will collectively form a generally uniform supporting surface, even though they are separated mechanically-to provide a wide gluing surface at their base.

These cushions provide uniform load supporting characteristics, but are difficult and expensive to manufacture, owing primarily to the large number of fins in each cell and to the fact they are dip molded from latex involving an expensive process. The dip molding and resultant fabrication of the cushion is an expensive labor intensive process which requires gluing a backing sheet to the cellular sheet while still maintaining the interconnecting open air passages between adjacent cells. Also, sensitivity allergic reactions to latex is much more prevalent than once was expected. Thus, an alternative to latex as a cushion cell material is desirable, even though latex cushion cells can be covered with neutral covers. The covers, however, tend to degrade the displacement and force equalization characteristics of the resultant cushion.

SUMMARY OF THE INVENTION

One of the objects of this invention is to produce a highly displaceable surface that deforms readily so that the soft tissues of a person engaging the surface deform very little and, therefore, do not interfere with blood flow in the tissues. A further object is to create a structure which can be fabricated from thermoplastic material at a reduced cost compared to non-thermoplastic materials.

Another one of the principal objects of the present invention is to provide a body supporting cushion having a multiplicity of vacuum formed or roto-cast cells. Another object is to provide an air filled cushion in which the cells are made from a suitable gas impervious thermoplastic material laminated to a suitable flexible backing sheet. Another object is to provide a cushion having vacuum formed cells whose upper portion is shaped to facilitate engagement into the cell and to eliminate hard corners, and which, when inflated and supporting a user, have substantially engaging sidewalls and which distend to form a substantially continuous upper supporting surface. Still another object is to provide such cushion with relieved top surface panels to assist in circulating air around and draining moisture from the skin of the patient so as not to seal off the pores. These and other objects and advantages will become apparent hereinafter.

DESCRIPTION OF THE DRAWINGS

In the accompanying drawings which form part of the specification and wherein like numerals and letters refer to like pans wherever they occur, FIG. 1 is a perspective view of a cushion of this invention in inflated condition and in the form of a 6×8 cell configuration mattress section;

FIG. 3 is a fragmentary side elevational view of the cushion shown in FIG. 1 prior to assembly;

FIG. 6 is a front elevational view of tile cushion shown in FIG. 1;

FIG. 7 is a side elevational view of the cushion shown in FIG. 1;

DETAILED DESCRIPTION

As will be explained in the detailed discussion of the drawings hereinafter, the design and construction of thin walled, pressurized cells, configured to provide a highly displaceable surface which can have a long life, requires a flexible material with low permeability, uniform wall thickness and minimum stress points. Some elasticity in the material is also desirable, but is not crucial to meet the stated goals.

Optimum function requires that the cells easily deform when displaced to assume a shape which closely approximates the contours of the object causing the displacement and also to equalize the forces acting on and along the supported object. In fact, one of the objectives is to synthesize all of the physical floatation properties of a fluid. These properties are low surface tension, constant restoring force vs. immersion depth, low friction and six degrees of freedom.

A surface configured with many mechanically independent cells that are interconnected by a fluid, such as air, can closely approximate these physical floatation properties of a fluid (See Graebe U.S. Pat. Nos. 3,870,450; 4,005,236; 4,541,136, et al.).

It is, therefore, important that the cell walls offer very little mechanical resistance when an object comes into contact with the cell. All the suspension forces should be obtained from the pressurized fluid residing in the cell. A zone of transition is required at the top of each cell which offers a low mechanical advantage and, therefore, little mechanical resistance to buckling the cell walls at the upper portion of the cell.

Flat tops on cells have a higher resistance to buckling at the edges where the side walls join the tops which, in turn, causes a high wear point in the cell and creates a soft tissue deformation point for the user. A cell top which extends above the side walls of the cell offers less resistance to buckling and does not have the foregoing disadvantages. In addition, the top of the cell must permit a folding action and some lateral motion as the cell is collapsed or telescoped by the object engaging it, without generating a shear component of force along the surface of the object engaging it, which also induces deformation of soft objects such as the soft tissues of the user.

When using cells that are circular in their cross section, a domed top is not as suitable as a cone top. When using hexagon or square cells, planar surfaces having a 10° to 40° incline that join at their tops are a better solution than domed tops to meet the function desired. The top point where these planar surfaces join together can be domed since a modest internal pressure (20 to 50 mmHg), causes the top point of thin wall structures to distend and becomes somewhat rounded.

Figure 2:
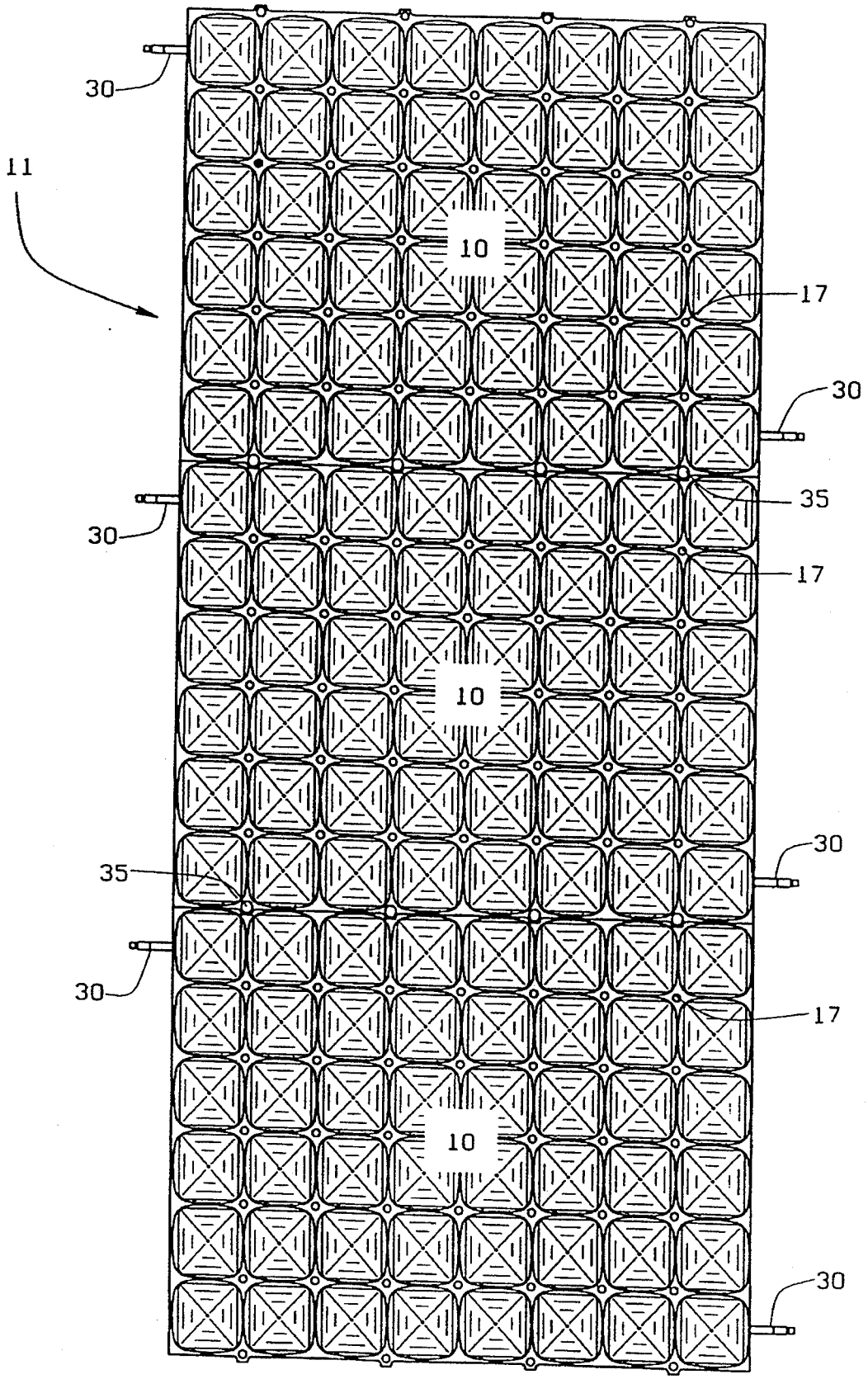
FIG. 2 is a top plan view of a series of three of the cushions of FIG. 1 connected together to form a mattress which will fit onto a hospital bed.

FIG. 1 shows a cushion 10 in the form of a mattress section. As will be explained in more detail hereinafter, a series of the mattress sections 10 may be fastened together to form a complete mattress 11 as shown in FIG. 2. The cushion 10 as shown is formed of six lateral cells 12 and eight longitudinal cells 12. This is known as a 6×8 cushion, but the number of cells 12 can vary, depending on the type and use of the cushion 10. As shown, the cells 12 are all thin wall flexible air cells of the same size and height, but the size and height can vary depending on the use for which the cushion 10 is designed. In addition, a 4×4 cushion section can be made part of the 6×8 cushion and removed when needed for use as a seat cushion which has an independent inflation valve and snaps, or is otherwise reattachable to the remainder of the cushion and mattress.

The formation of thin walled flexible air cells can be achieved in various ways, e.g., dipping, vacuum-forming, roto-casting, injection molding and transfer molding, but vacuum-forming is preferred.

The method of forming the cells can limit the aspect ratio of the cell (base to height ratio). The least costly method, when using thermoplastic materials, is vacuum-forming. Vacuum-forming is limited by the draw ratio of stretching a film. This ratio should not exceed 4. To achieve an effective immersion depth for a mattress, a cell height, measured above its base, needs to be at least 3 inches. For practical purposes in constructing a mattress or seat cushion, its overall dimensions must be compatible with standard bed frames or seating devices such as wheelchairs. As will be discussed in more detail hereinafter, for mattress applications a cell width (using vacuum-forming methods) of 4×4 inches, plus a space for heat sealing or gluing a bottom piece, achieves a cell height of greater than 3 inches and an assembled width and length that matches U.S. hospital beds. The choices for cell dimensions of the base are somewhat limited by the necessity for fitting predetermined bed sizes.

When considering a wheelchair application a much wider selection of cushion and cell sizes is required It is therefore, necessary to have smaller base sizes of the cells which in turn limits the cell heights to less than 3 inches. The base sizes do not need to be square. They can also be rectangular to work out overall cushion dimensions.

Figure 8:
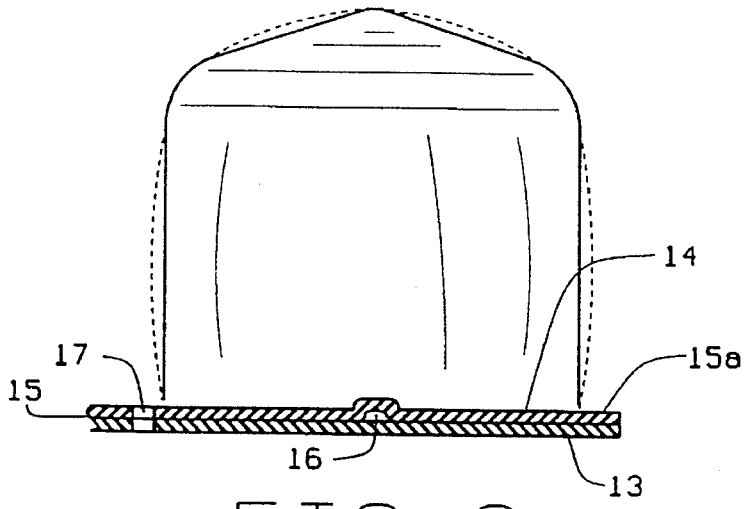
FIG. 8 is a fragmentary sectional view taken along line 8—8 of FIG. 4.
Figure 9:
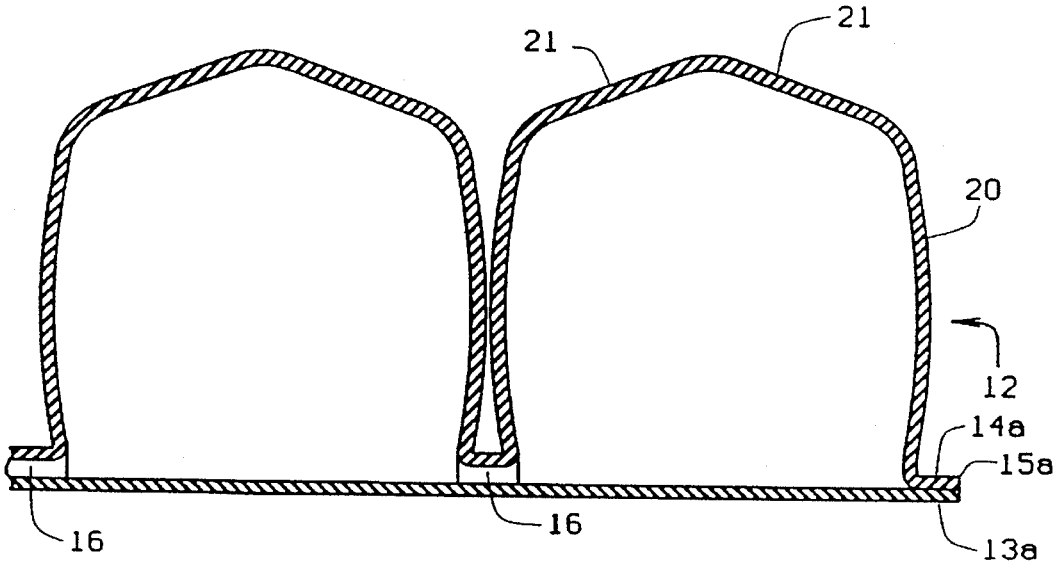
FIG. 9 is a fragmentary sectional view taken along line 9—9 of FIG. 4.

The cushion 10 has a base sheet 13 and a top preformed sheet 14. The top sheet 14 is preformed into the cells 12 by vacuum and/or heat and has a border 15 surrounding each of the cells 12 (FIG. 8).

The top sheet 14 and the base sheet 13 are compatible gas impervious thermoplastic polymers such as polyethylene, polypropylene, polyester, nylon, polyvinylchloride, polyvinylidene, polyurethane, etc., having a thickness which may range from about 15 mil to about 40 mil or more, depending upon the use of the cushion and the method of formation. The top sheet 14 and the base sheet 13 can be the same or different thicknesses. The sheets 13 and 14 are abrasion and wear resistant as well as being gas impervious. If the cushion 10 is to be used directly against the skin, the top surface of the top sheet 14 must be compatible to contact with the skin. The cushion 10 also can be encased in a cover such as shown in my U.S. Pat. No. 5,111,544. The cushion 10 also must withstand moisture and body fluids.

The cells 12 are preformed in the sheet 14 by vacuum and/or heat so they may be collapsed or distended in response to air pressure inside the cells 12 and pressure of the body of the person sitting or lying on the top surfaces of the cells 12. The boundaries or borders 15 around each of the cells 12 are sealed to the base sheet 13 by heat, solvents or adhesives, except for passages 16 which interconnect the cells 12. The cells 12 can all be connected by passages 16 or segments or groups of the cells 12 can be independently interconnected, so that the groups of cells are each separately inflatable independently of the remainder of the cushion. Around the periphery of the cushion 10 is a peripheral margin or border 15*a* defined by the peripheral borders or margins 13*a* and 14*a* of the base sheet 13 and the top sheet 14 respectively.

Figure 5:
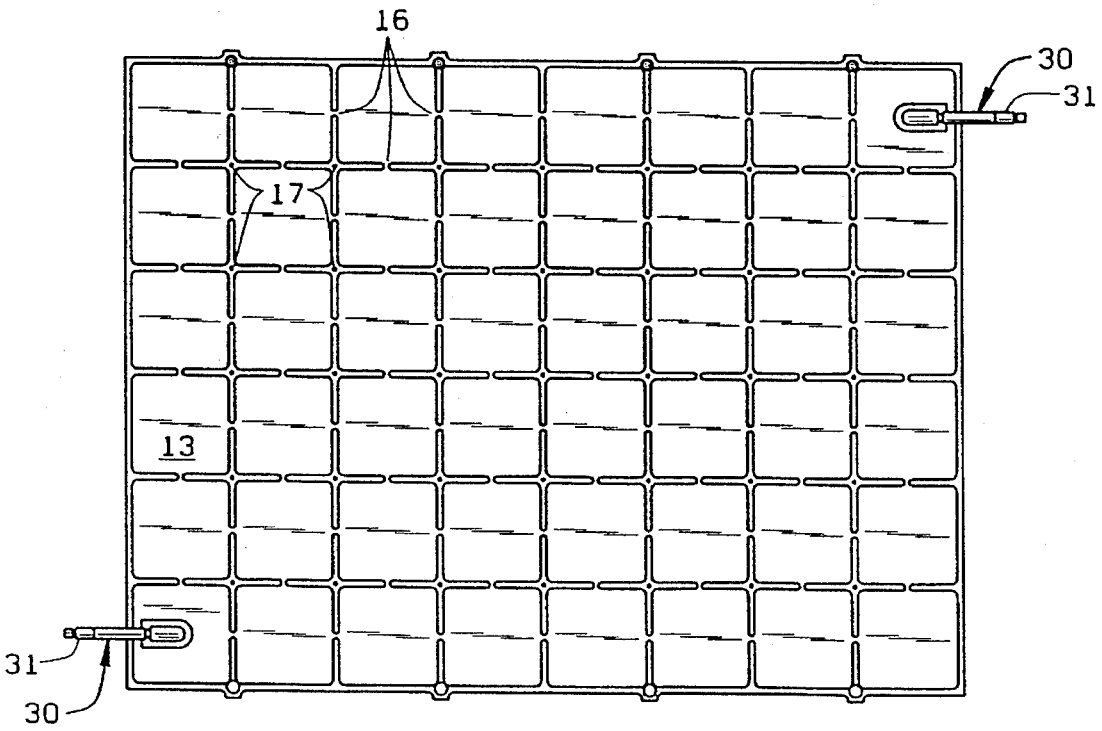
FIG. 5 is a bottom view of tile cushion shown in FIG. 1.
Figure 22:
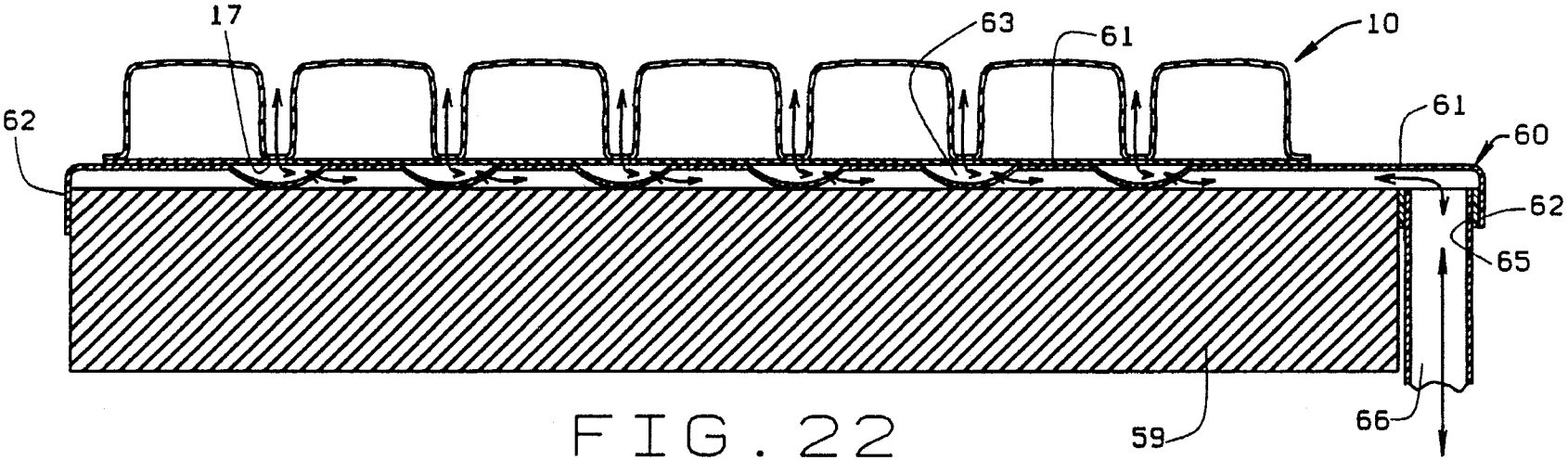
FIG. 22 is a fragmentary vertical sectional view of a modification of this invention.
Figure 24:
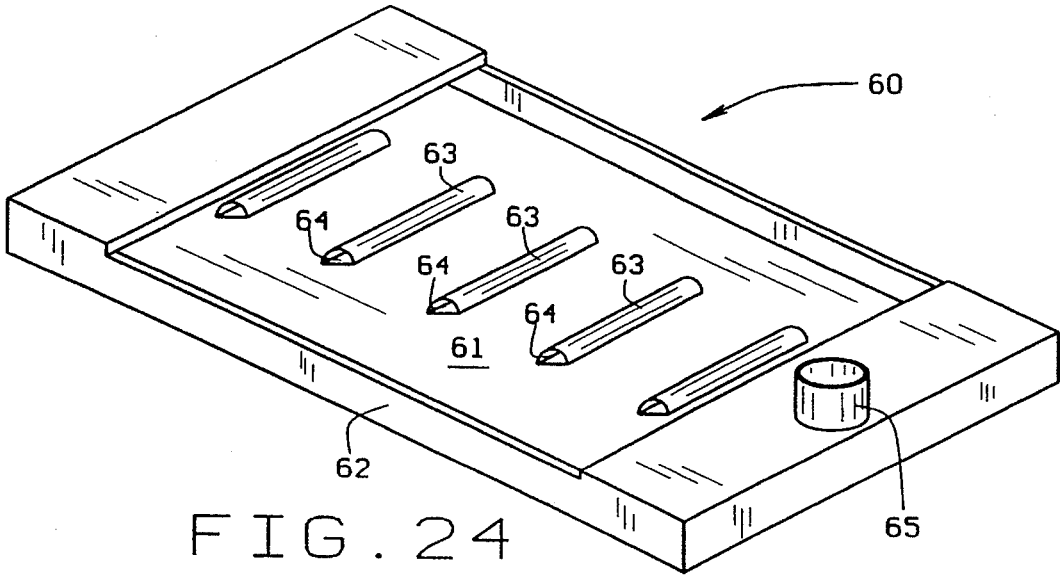
FIG. 24 is a bottom perspective view of a manifold distributor used with the modification shown in FIGS. 22 and 23.
Figure 23:
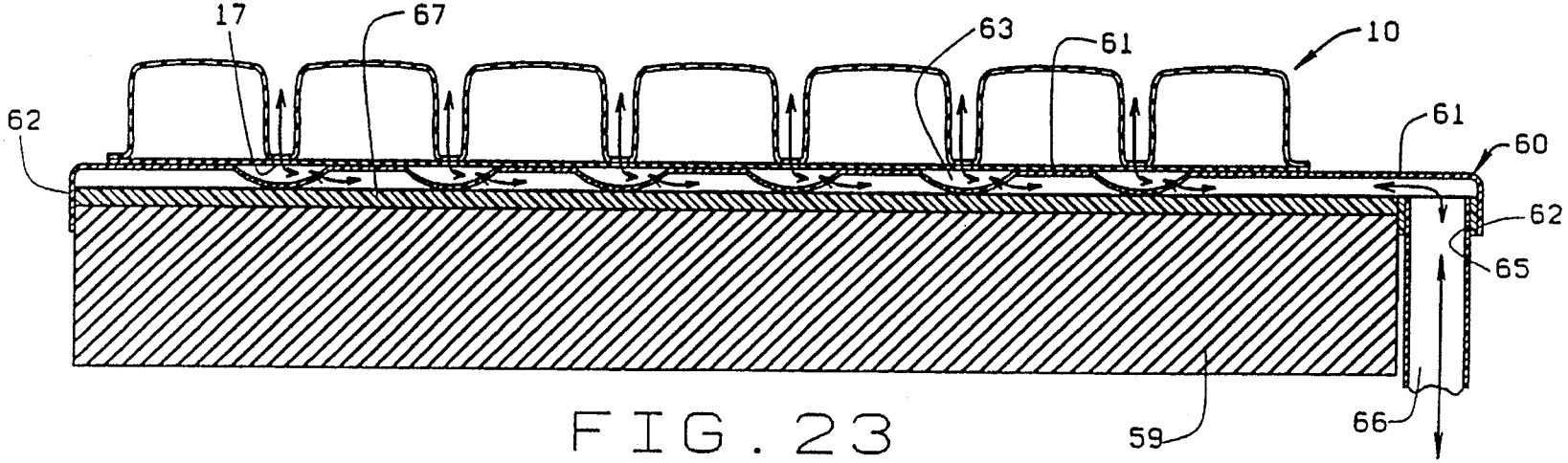
FIG. 23 is a fragmentary vertical sectional view similar to FIG. 22 but showing an absorbent pad beneath the manifold.

As shown in FIG. 5, the passages 16 are positioned along the edges of the cells 12 between the ends, so that the corners are available for the formation of openings or holes 17 for fluid exchange. This is important because when a person is being supported on the cells 12, they produce a source of moisture or other bodily fluids, such as urine, perspiration, wound drainage, etc. An absorbent pad can be placed under the mattresses to collect and contain these fluids (FIG. 23). The tops of each cell 12 can be embossed as shown by the numeral 25 in FIGS. 1 and 15 to prevent sealing off the pores of the skin to provide ventilation and drainage. The holes 17 can be provided through the base, 13, 14 of the mattress 10 or seat cushion between the cells 12 to permit fluids to be drained away as hereinbefore discussed or to permit forcing of conditioned air up from below by using an air distribution manifold 60 shown in FIGS. 22 and 23.

Figure 26:
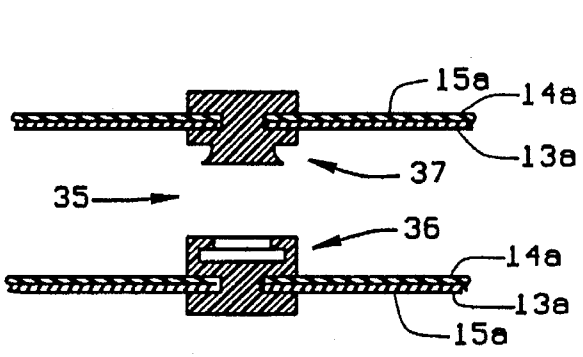
FIG. 26 is a vertical sectional view of a snap fastener for fastening two cushions together in forming a mattress.
Figure 21:
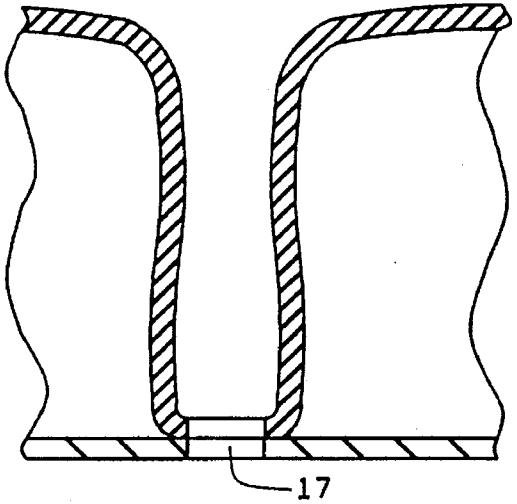
FIG. 21 is a fragmentary sectional view taken along line 18—18 of FIG. 4.

The manifold 60 is placed on a bed 59 and supports the mattress 10. The manifold 60 itself is a relatively rigid vacuum formed plastic part which is slightly larger in length than the mattress 10 which it supports and about the same width as the mattress section 10. It has a smooth top surface 61, side edges 62, a series of spaced curved segments 63 which have open ends 64 and depend downwardly from the top 61, and an air hose connection 65 at one side. The segments 63 rest on the bed 59 and the mattress 10 rests on the manifold with the openings 17 aligned with the manifold curved segments 63. Thus there is a space created between the bed 59 and the mattress 10. Conditioned air is passed through a conduit 66, which is connected to the manifold hose connection 65, into the space between the mattress 10 and the bed 59 and through the openings 17 in the mattress 10. There also is space to install absorbent pads to collect and contain body fluids as will be explained hereinafter. Since the manifold curved segments 63 have open ends 64 and since the mattress holes 17 are aligned with the segments 63, the air from the conduit 66 is passed directly to the body of the patient lying on the mattress 10. Locating the segments 63 beneath the mattress openings 17 allows body fluids to drain away from the mattress 10 into the manifold 60. The manifold 60 also can be used to exhaust air from around the patient and from the patient's room. Thus, contaminated air can be discharged to a remote location outside the patient's room. To keep tire mattress section 10 in position, snaps or Velcro fasteners (as shown in FIG. 26) can be provided to attach the mattress section 10 to the manifold 60.

FIG. 23 shows a modification of tire invention in which an absorbent pad 67 is positioned on the bed 59 beneath the manifold 60. When body fluids pass from the open ends of the curved segments 63 they are absorbed by the pad 67 positioned on top of the bed 59.

The mattress air cells 12 are generally parallel to each other and as shown, are of the same size and configuration. The cells 12 are arranged in transverse and longitudinal rows to form an array of rectangular configuration.

The cells 12 are shown as rectangular, (square) but hexagonal cells also can be used. These create partial blank spots along the edges unless half cells are used. These half cells, however, do not collapse or telescope the same as a full symmetrical cell does.

Figure 4:
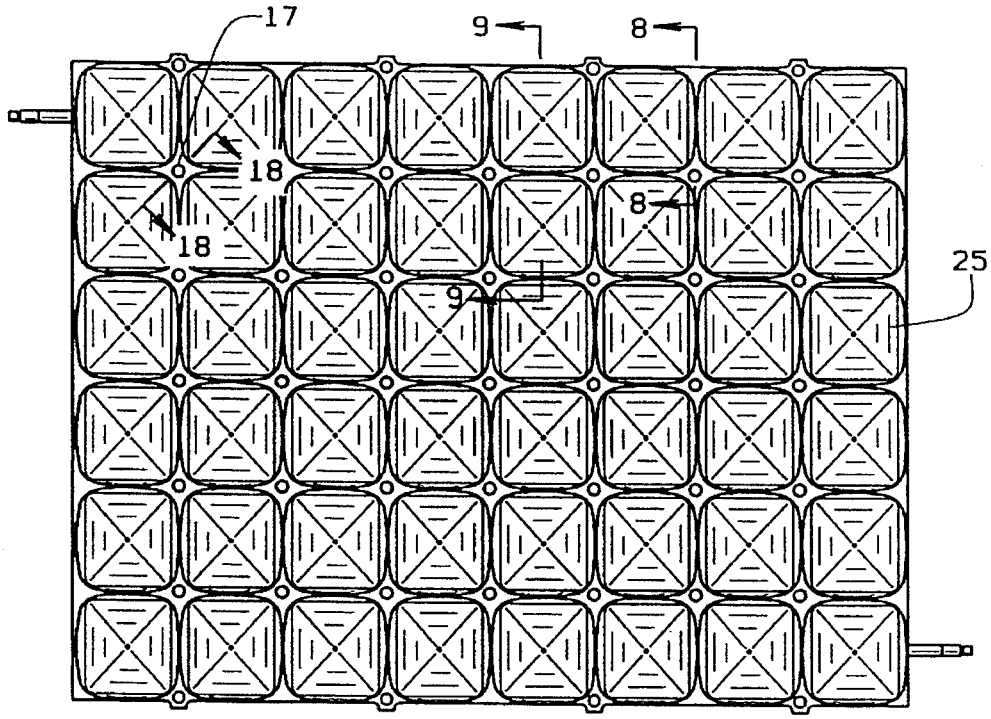
FIG. 4 is a top plan view of the cushion shown in FIG. 1.

One or more of the air cells 12 at a corner of the cushion 10 is provided with an air tube 30 through which air may be introduced into the cushion 10 for inflating its air cells 12 (FIGS. 5 and 11–13). The tube 30, in turn, contains a manually operated open and close valve 31. As shown in FIG. 4, the mattress section 10 is provided with two fill tubes 30. However, only one tube 30 is necessary and the second tube 30 is optional for the convenience of the user.

Within the base sheet 13 adjacent air cells 12 are connected in the sense that their interiors are in communication with each other, so that when the air cells 12 are inflated through the tube 30, all will exist at the same pressure. Similarly, should a load deflect some of the air cells 12 more then the others, the pressure within all of the air cells 12 will nevertheless equalize. Thus, the cushion 10 will exert a generally uniform force on the surface area of any body supported on it, even though that body may be of complex and irregular contours and deflect some of the air cells 12 more than others. By reason of these characteristics, the cushion 10 is ideally suited for use as a mattress, a portion of a mattress, a seat cushion; or a back rest.

Figure 10:
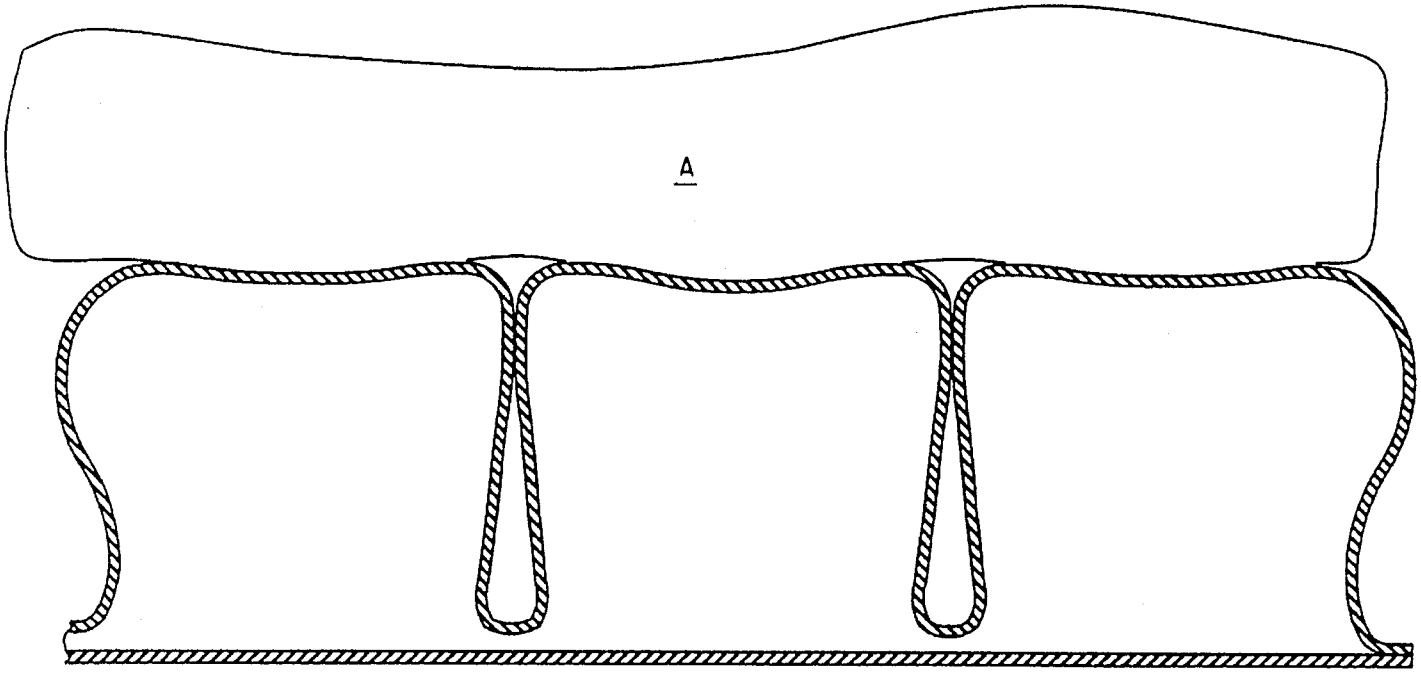
FIG. 10 is an enlarged fragmentary sectional view of the cushion of this invention with a patient lying on the inflated cushion.

The cells 12 have easily distensible upright wall sections 20 which define a rectangular shape and four triangularly shaped upwardly sloped top sections 21 which cover the rectangular base. The top sections are sloped at 10°–40° incline. This angle is a function of cell base size, i.e., large base sizes can have less slope than small base sizes. For appearance, a constant slope is used, using the smallest cell as the choice of slope angle. When inflated to match or slightly exceed atmospheric pressure, the top portion of each cell 12 defines a generally pyramidal shape. This unstressed structure is shown by the solid lines in FIG. 8. The area at the top of the wall panels 20 and the top sections 21 forms a zone of transition which offers little mechanical resistance to the cells walls 20 at the upper portion of the cell 12. Additional inflation of the cells 12 will cause the tops 21 to round and the sides 20 to distend to the broken line positions of FIG. 8. This causes adjacent side walls 20 to engage and support each other and causes the tops 21 to become closer and closer to a continuous non-broken supporting surface. FIG. 10 shows how the top surfaces 21 provide a substantially continuous surface when a patient "A" is on the cushion 10 and how the side panels 20 engage and support each other. The pyramidal top area, which is composed of the triangular panels 21, tends to flatten out and define a continuous top or load supporting surface. It is to be expected that protruding parts of the patient's anatomy, such as head, elbows, heels, buttocks, and hips, will immerse deeper into the cushions 10, and this effect can be large compared to the overall continuous surface effect because of the highly displaceable properties created by the present invention Even so, the force exerted on any body part is generally uniform, even with a deeper immersion All corners above the cell base 13 and the upstanding side walls 20 shown in FIG. 1 have generous radii while maintaining uniformity of wall thickness to distribute stresses in the material used to form the cell. The combination of uniform wall thickness, generous radii, and a top that permits low shear engagement produces an effective long life piston (cell). In addition, selecting a material which has a low coefficient of friction enhances life and function.

FIG. 2 shows a series of cushions 10 connected together to form a mattress 11. The cushions 10 are connected by suitable fastening means 35, which may be VELCRO fasteners, snap fasteners, etc. A typical snap fastener 35 is shown in FIG. 26 and comprises a female element 36 and an interlocking male element 37. The fastening means 35 are positioned in the outside longitudinal edge borders 15 and are sterilizible using conventional heat or chemical processes.

Figure 15:
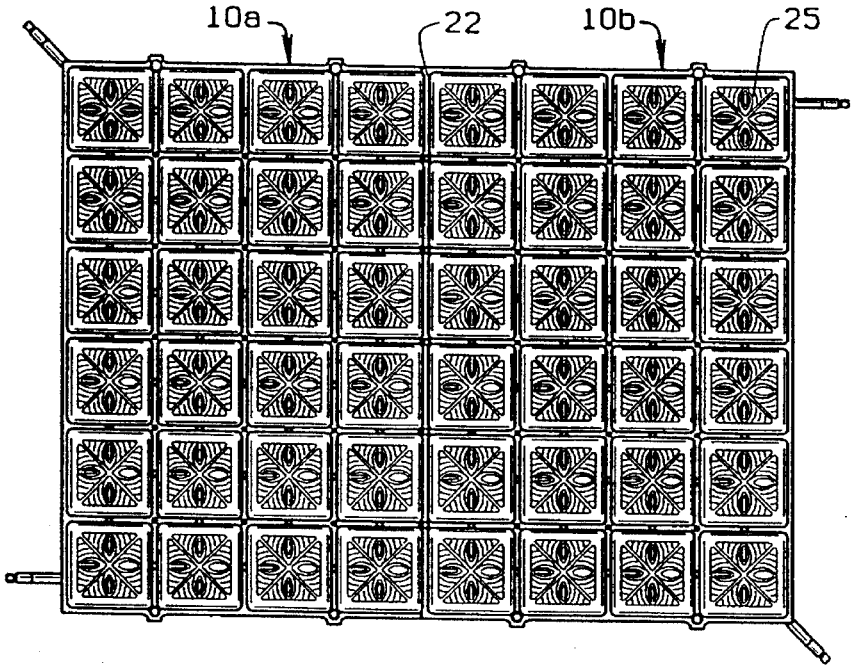
FIG. 15 is a plan view of a modified cushion divided into two separate compartments.

FIG. 15 shows a modification of a cushion 10. The cushion shown in FIG. 15 is sectionally divided along the centerline 22 so that the left section **10*a* can be inflated to a pressure different from the pressure in the right section 10*b*. Thus, when these cushions are formed into a mattress as shown in FIG. 2, the patient can be supported against or assisted in rolling to the right or left depending on the medical necessities. Also, if the individual cushion 10 is used as a wheelchair cushion, the user can be positioned and supported by different amounts of inflation in parts 10*a* and 10*b***.

Figure 16:
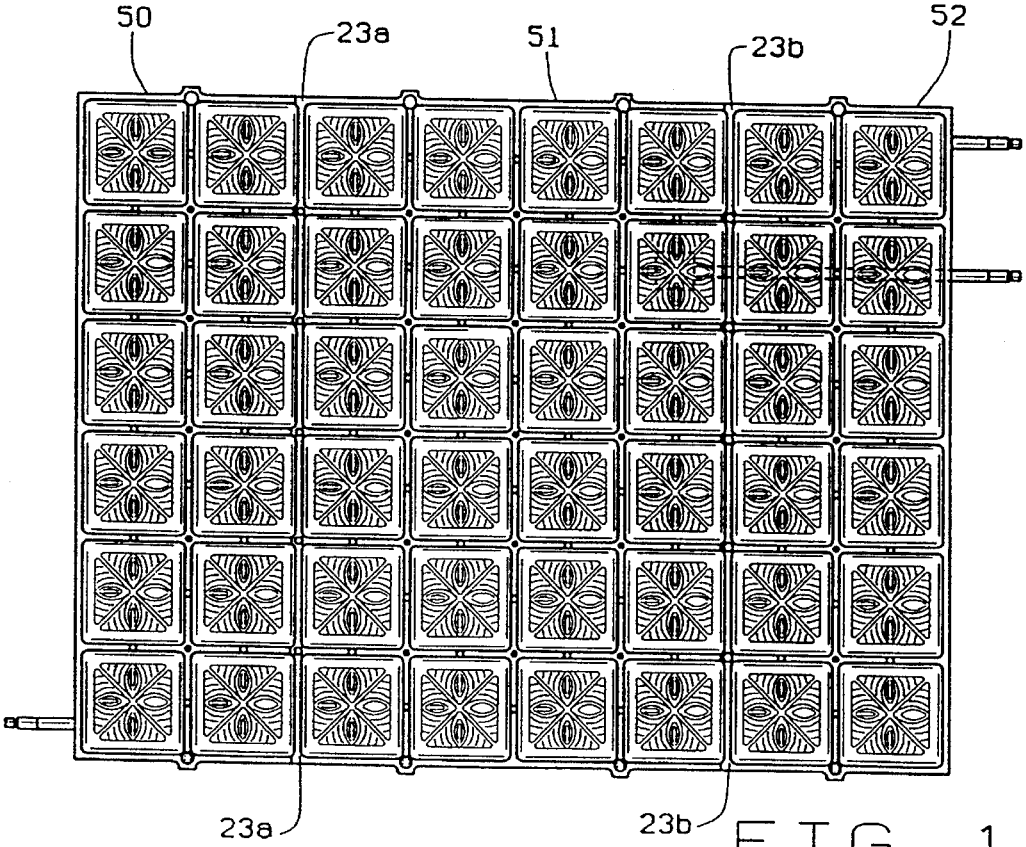
FIG. 16 is a plan view of another cushion modification in which the cushion is divided into three individual compartments.

FIG. 16 shows another variation of the cushion 10 This modification shows a cushion which is divided along lines **23*a* and 23*b* so that three compartments are formed, a left compartment 50, a center compartment 51 and a right compartments 50–52 are separately inflatable. Thus, the outer compartments 50, 52 can be inflated harder than the center section 51**. This will pro, vent a patient from rolling out of the mattress or in the case of a wheelchair or vehicle cushion provide an anti-roll function while optimizing the distribution of load to the ischial tuberosities for the seated person.

Figure 17:
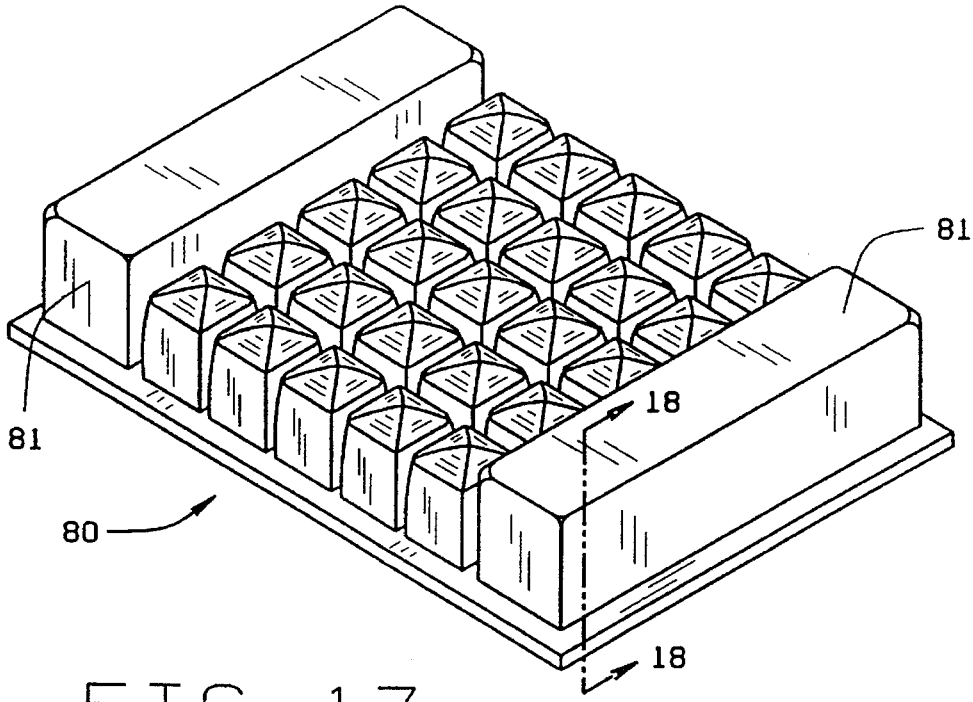
FIG. 17 is a perspective view of a modified cushion having large continuous edge cells.
Figure 18:
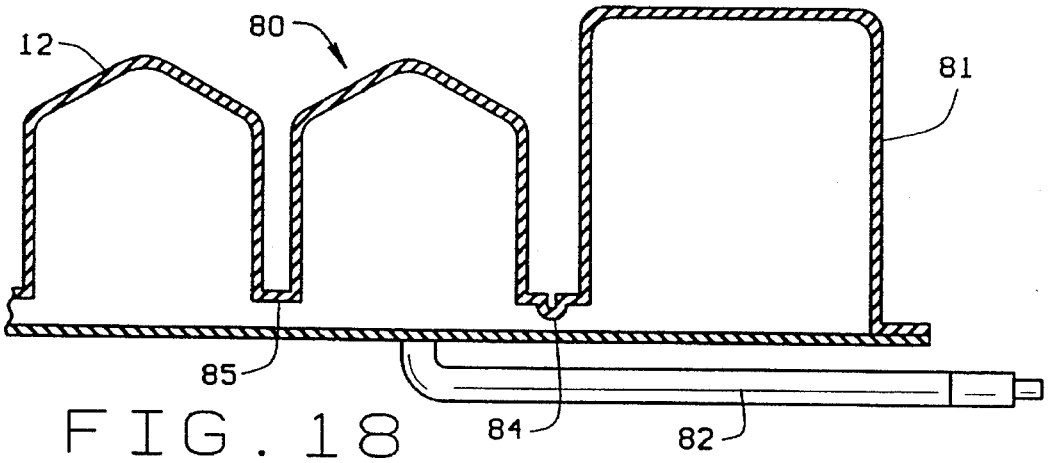
FIG. 18 is a fragmentary vertical sectional view of one form of the cushion shown in FIG. 17.
Figure 19:
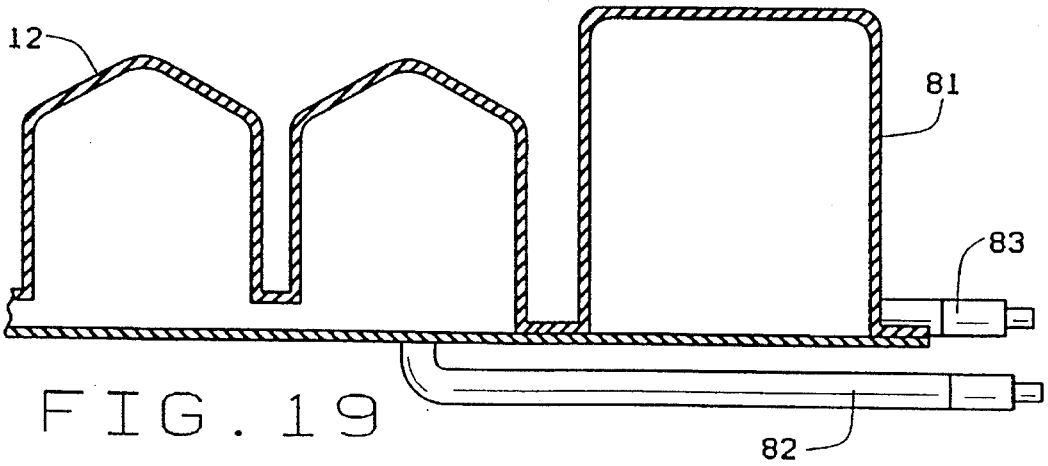
FIG. 19 is a fragmentary vertical sectional view similar to FIG. 18, but of a modification of the cushion shown in FIG. 17.

FIGS. 17–19 Show another variation of the cushion or mattress 80 of this invention suitable for providing an anti-roll function. This embodiment 80 involves the placement of a large continuous edge cell 81 on each side edge of the cushion 80. These edge cells 81 provide an edge resistance to prevent the user rolling off of the mattress section 10. As shown in FIG. 17, the cells 12 between the edge cells 81 are similar to those shown in FIG. 1.

The edge cells 81 can be pneumatically independent (FIG. 19) or interconnected (FIG. 18) where the mattress section 80 requires only one air fill valve 82 going directly to the center group of air cells 12. In the embodiment shown in FIG. 19, each of the side edge cells 81 is provided with a fill valve 83 and the center cells 12 also have fill valve 82. All of the valves 82,83 are independent and allow the edge cells 81 to be inflated independently and to different pressures from each other and from the center cells 12. The center cells 12 are interconnected so all exist at substantially the same pressure.

In the modification shown in FIG. 18, the center cells 12 and the edge cells 81 are all interconnected and only one fill valve 82 is provided to a center cell 12. However, the passages 84 between the center cells 12 and the edge cells 81 are restricted compared to the size of the passages 85 between each center cell 12. This allows the edge cells 81 to maintain air pressure and rigidity even if the user moves about on the center cells 12 and exerts a force on an edge cell 81. The edge cell 81 will retain air and retain its shape to urge the user back toward the center of the mattress 80.

Figure 20:
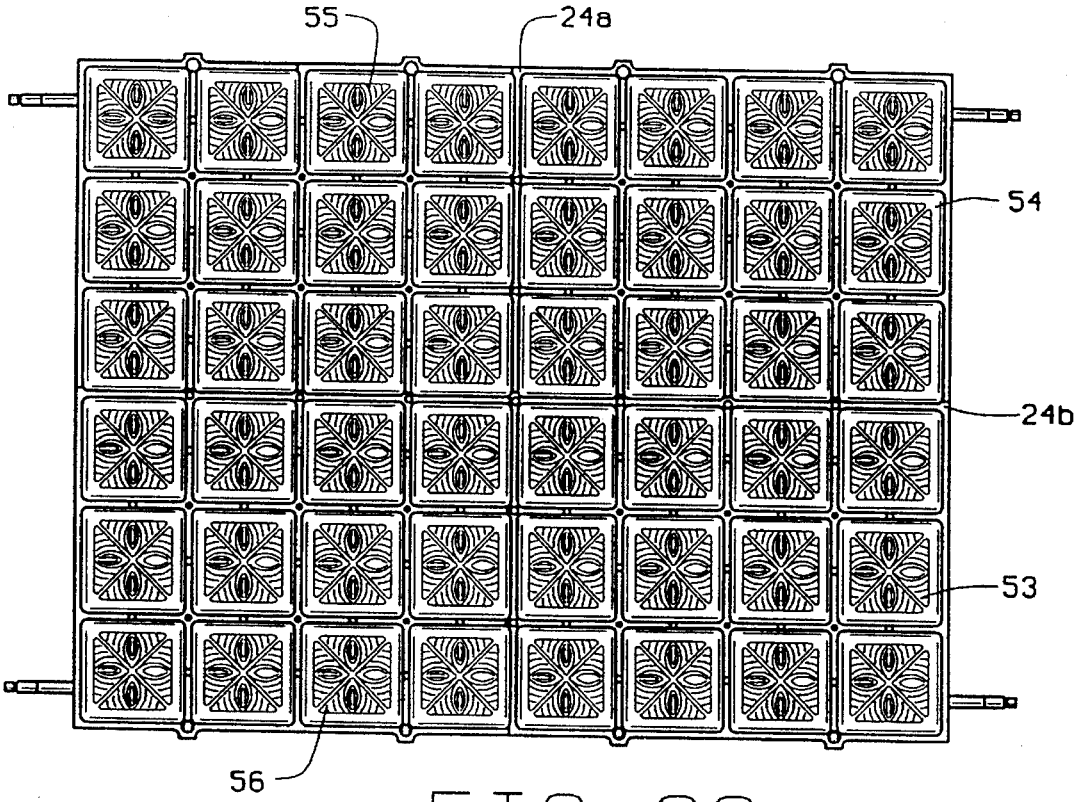
FIG. 20 is a plan view of a further cushion modification in which the cushion is divided into four compartments.

FIG. 20 shows still another variation of the invention. This variation of the cushion 10 is divided into four compartments 53, 54, 55 and 56, by the seal lines **24*a* and 24*b* which run from end-to-end and side-to-side of the cushion 10. This is particularly suited for a wheelchair cushion because it allows adjusting the placement of the patient or user of the chair by quadrant. The pressure in each of the sections 53–56** can be individually adjusted to locate or position the user in the wheelchair.

As shown in FIG. 5, the inflating tubes 30 can be inserted into the cushion 10 through tile base wall 13 adjacent to a cushion corner or to any edge. It is important that the inflating tubes 30 not be placed on the edges containing snaps.

Figure 11:
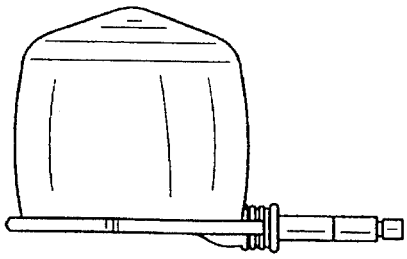
FIG. 11 is a fragmentary side elevational view of an air inflating valve for the cushion of FIG. 1.
Figure 12:
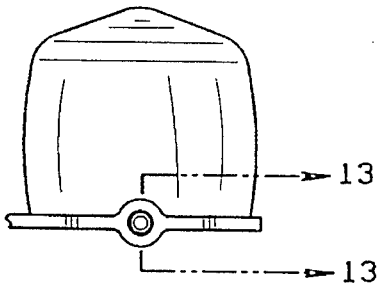
FIG. 12 is an end elevational view of the valve shown in FIG. 11.
Figure 13:
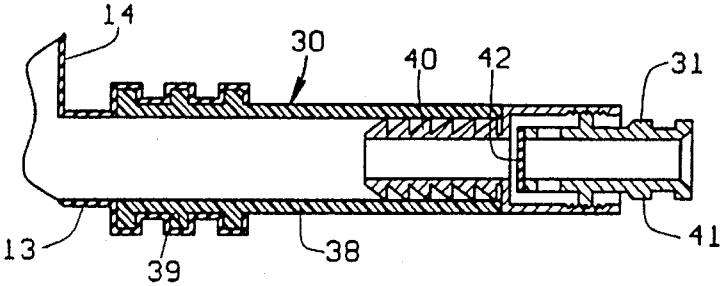
FIG. 13 is an enlarged sectional view taken along line 13—13 of FIG. 12.

Another method of fastening the inflating tubes 30 is shown in FIGS. 11–13. In this application, the inflating tubes 30 comprise a semi-rigid thermoplastic tubular extension 38 which has annular ribs 39 that are heat sealed or otherwise welded to the base 13 and the top sheet 14. The metallic valve 31 is formed in two pans and includes a body 40 which is glued or otherwise welded to the tubular extensions 38 and a cut-off member 41 which is threaded to the body 40. The cut-off member 41 has a seal 42 and can be rotated to open or close access to the extension 38.

Figure 14:
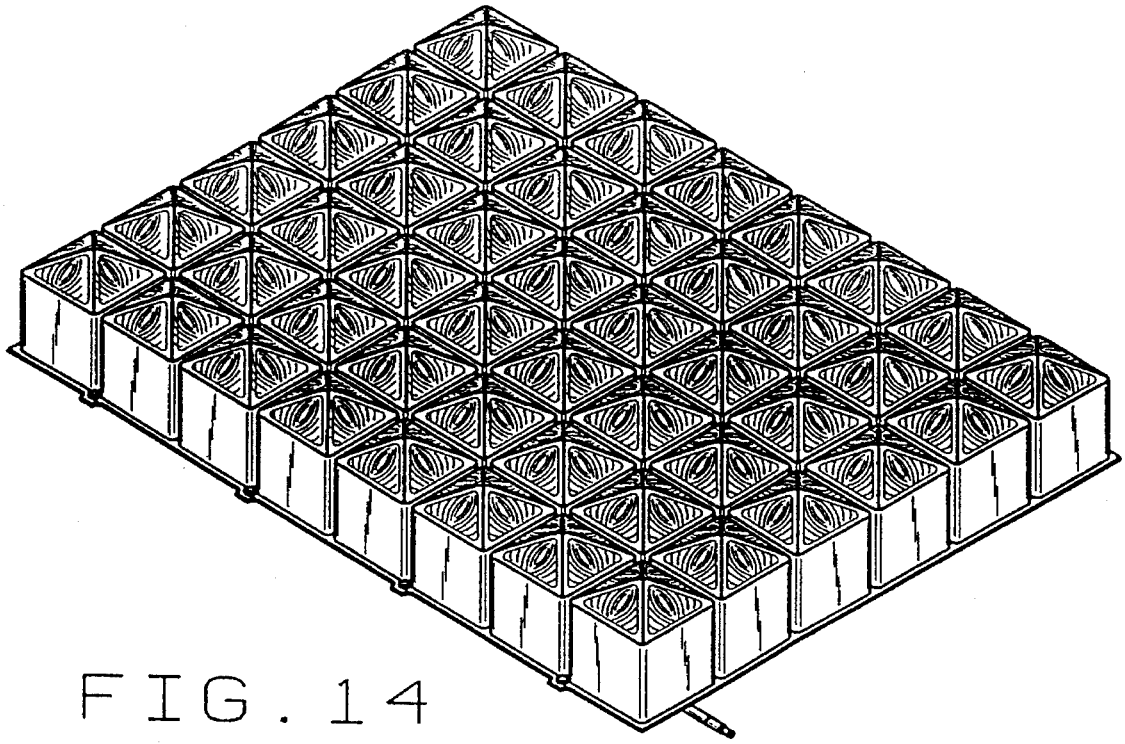
FIG. 14 is a perspective view of a cushion showing a modified form of surface relief.

FIGS. 4 and 14 show different forms of surface irregularities 25 in the triangular panels 21 which allow air to circulate between the surface of the cushion 10 and the skin of the patient.

Figure 25:
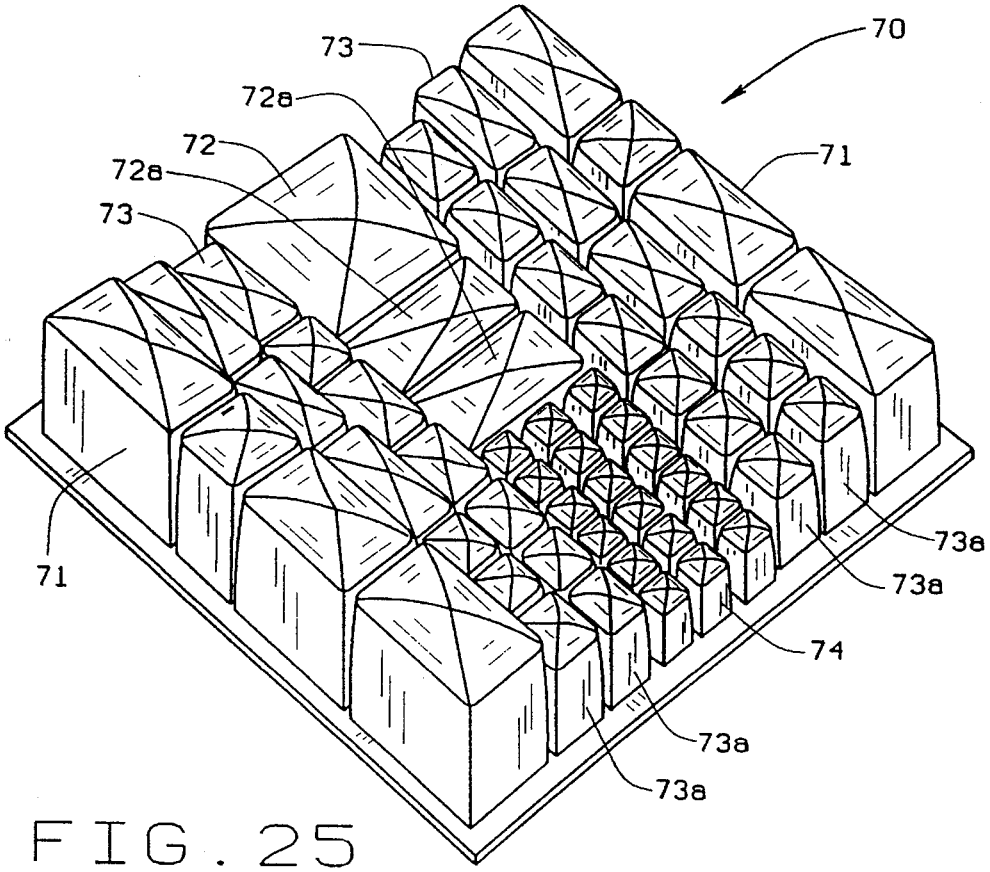
FIG. 25 is a perspective view of a modified wheelchair cushion embodying this invention.

Another modification of the invention is specifically directed to wheelchair cushions and is shown in FIG. 25.

For mattress applications a cell width (using vacuum-forming methods) of 4×4 inches, plus a space for heat sealing or gluing a bottom piece, achieves a cell height of greater than 3 inches and an assembled width and length that matches United States hospital beds. Different cell widths can be selected to fit other sized beds, and if the cell width is smaller, cell depth also will be smaller, if vacuum forming methods are used. If injection molding or roto molding methods are used, this restriction does not apply When considering a wheelchair application, a much wider selection of cushion and cell sizes is required. It is, therefore, necessary to have smaller base sizes of the cells which in turn limits the cell heights to less than 3 inches. The base sizes do not need to be square. They can also be rectangular to work out cushion dimensions.

The shape of a person's buttocks varies considerably, especially from disabled to abled bodied, from fat to thin and tall to short. To solve this problem of cushion size to cell depth problem for vacuum-form structures, a combination of cell base and height sizes can be used. The large cell base sizes with their greater cell heights can be used oil the edges of the support surface and smaller cell base sizes with their smaller heights can be used in the central portion of the cushion. This combination produces a seat cushion having a contoured surface that also presents a higher resolution displaceable surface exactly where it is needed to better fit the bony contours of the ischial tuberosities.

As specifically shown in FIG. 25, the cushion 70 comprises high rectangular cells 71 along the side edges to restrain the legs of the occupant and a high, generally square abductor cell 72 at the front of the cushion 70 between the side cells 71 to also position the legs of the user and retain the user on the cushion 70. Between the abductor cell 72 and the edge cells 71 are intermediate sized leg supporting cells 73 which define a trough for supporting the legs of the user. At the center rear of the cushion 70 behind the abductor cell 72 are a series of smaller and lower cells 74 which support the ischial tuberosities. Intermediate cells 72*a* at the rear leading from the side cells 71 to the small cells 74 can decrease in height or size from the side edge toward the center. Also there can be a series of cells 72*a* of decreasing height from the abductor cell 72 to the small cells 74. The cells 71–74 can all be interconnected, or each series of different sized cells can be separately inflatable.

Figure 27:
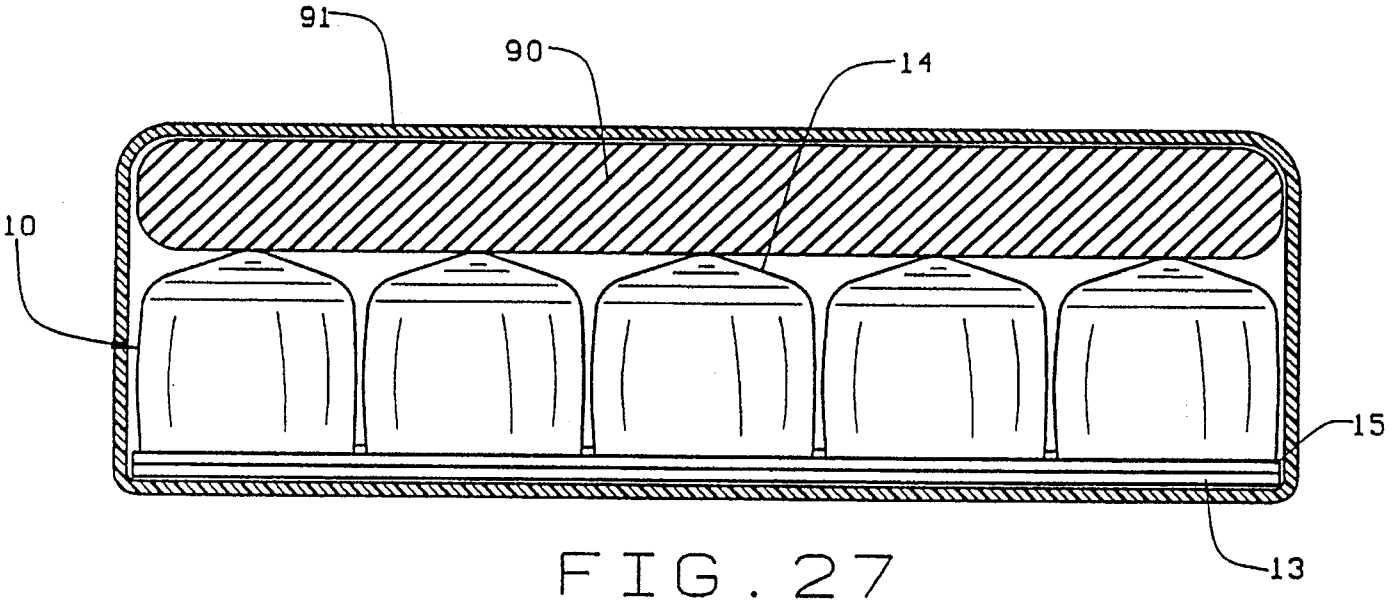
FIG. 27 is a partial sectional view of a modification of the invention showing a foam pad placed on top of an air cell assembly with a cover enclosing the entire structure.

Depending upon the medical need, a foam piece 90 can be placed over the top, bottom or sides of the mattress 10 or seat cushion as shown in FIG. 27 (top only shown) The use of a foam topper compromises the displacement and the equalization of forces acting on the supported body, but is perceived as more comfortable than lying directly on the cells by many people, and tends to reduce any sounds generated by movement of the cells as they may buckle or change shape in response to movement of the person lying on the mattress.

In addition, a moisture barrier sheet or ordinary sheet or cover 91 can also be installed over the surface to facilitate cleaning, if incontinent persons are using the mattress or seat cushion.

This invention is intended to cover all changes and modifications of the example of the invention herein chosen for purposes of the disclosure which do not constitute departures from the spirit and scope of the invention.

What is claimed is:

1. An inflatable cushion comprising:

a flexible, gas impervious bottom wall;

a preformed, flexible, gas impervious top sheet formed with a plurality of air cells;

each air cell having a lower portion and an upper portion extending above the lower portion, the lower portion having a generally cubical shape defined by four generally vertical interconnected side walls each having a bottom edge and a top edge, the upper portion of each air cell being defined by four substantially triangular panels which incline upwardly from the lower portion of the air cell and meet in an apex, giving the upper portion a generally pyramidal shape extending upwardly from the top edges of the side walls to an apex of the air cell;

air-tight seals attaching the top sheet to the bottom wall along the bottom edges of the air cell side walls, the air cells being inflatable to support an exterior load thereon;

the side walls of each air cell being spaced laterally from the side walls of adjacent air cells when the air cells are not inflated, but being positioned sufficiently close to the side walls of adjacent air cells to distend and contact the side walls of adjacent air cells when the air cells are inflated and not subjected to an exterior load.

2. The cushion of claim 1, wherein:

the cushion has opposite lateral edges and air cells positioned along the opposite lateral edges have heights that are larger than heights of the other air cells.

3. An inflatable cushion comprising a flexible gas impervious bottom wall, a preformed flexible gas impervious top sheet defining a plurality of air cells, and air-tight seals attaching the top sheet to the bottom wall at edges of the air cells except for limited sections between selected adjacent air cells defining passages for allowing fluid communication between the selected adjacent air cells;

wherein each air cell includes an upper portion and a lower portion, the lower portion having a parallelepiped shape defined by four generally vertical side walls, the upper portion extending above the side walls of the lower portion, the upper portion of each air cell being defined by four substantially triangular panels which incline upwardly from the lower portion of the air cell and meet in an apex, giving the upper portion a substantially pyramidal shape at a first inflation pressure of the air cells, the side walls of the lower portion and the pyramidal upper portion being flexible and distensible so that the pyramidal upper portion becomes rounded and the side walls of the lower portion distend outwardly at a second inflation pressure of the air cells, the second inflation pressure being higher than the first inflation pressure, the plurality of air cells being in close proximity to one another so that the side walls of adjacent air cells engage one another when the side walls distend outwardly thereby defining a substantially level and continuous load supporting surface of the cushion at the second inflation pressure of the air cells.

4. The cushion of 3 wherein the triangular panels are inclined at an angle of about 10° to about 40°.

5. The cushion of claim 3 wherein an outer surface of the upper portion of at least some of the plurality of air cells is textured to prevent sealing off the pores of the skin of the user of the cushion by the cushion.

6. The cushion of claim 3 wherein the cells are formed from a thermoplastic polymeric film selected from the group consisting of polyethylene, polypropylene, polyesters, nylon, polyvinyl chloride, polyvinylidene, and polyurethane.

7. The cushion of claim 3 wherein the seals are heat, solvent or adhesive seals.

8. The cushion of claim 3 further comprising a valve connected to at least one air cell to allow air to be added to or released from the cell, the valve being connected to the cushion through the bottom wall of the cushion.

9. The cushion of claim 3 further comprising a valve connected to at least one air cell to allow air to be added to or released from the cell, the valve being connected to the cushion at a side edge and is sealed between the top sheet and the bottom wall.

10. The cushion of claim 3 including openings through the bottom wall of the cushion adjacent to the corners of the cells to allow body fluids of the user to pass through the cushion and conditioned air to be supplied from a remote source to the body of the user.

11. The cushion of claim 3 including large continuous edge cells along the longitudinal edges of the cushion with smaller air cells therebetween, the structure providing edge resistance to rolling off the cushion.

12. The cushion of claim 11 wherein the edge cells are pneumatically independent of each other and of the smaller air cells therebetween.

13. The cushion of claim 11 wherein the edge cells are pneumatically connected to the smaller air cells therebetween.

14. The cushion of claim 13 wherein the pneumatic connection between the edge cells and the smaller air cells is substantially restricted compared to the pneumatic interconnection among the smaller air cells.

15. The cushion of claim 3 including an expanded plastic foam pad positioned over the top surfaces of the air cells.

16. The cushion of claim 15 including a cover enclosing the foam pad and the cushion.

17. The cushion of claim 15 wherein the cover is moisture impervious.

18. The cushion of claim 3 wherein the triangular panels of the upper portion of each air cell are inclined at an angle which is a function of the horizontal dimensions of the lower portion of each air cell.

19. The cushion of claim 3 wherein the first inflation pressure is approximately equal to atmospheric pressure.

* * * * *